United States Patent [19]

Wang

[11] 4,266,987

[45] May 12, 1981

[54] PROCESS FOR PROVIDING ACID-RESISTANT OXIDE LAYERS ON ALLOYS

[75] Inventor: Chih-Chung Wang, Lexington, Mass.

[73] Assignee: Kennecott Copper Corporation, New York, N.Y.

[21] Appl. No.: 790,498

[22] Filed: Apr. 25, 1977

[51] Int. Cl.[3] ..... C23C 11/00

[52] U.S. Cl. ..... 148/6.3; 427/309; 427/327; 427/331; 427/372.2; 427/399; 427/444

[58] Field of Search ..... 427/309, 399, 444, 318, 427/327, 372.2, 331; 148/6.3, 6.35

[56] References Cited

U.S. PATENT DOCUMENTS

| | | | |
|---|---|---|---|
| 2,269,601 | 1/1942 | Perrin | 148/6.35 |
| 2,269,943 | 1/1942 | Kiser | 148/6.35 |
| 2,442,223 | 5/1948 | Uhlig | 148/6.35 |
| 2,936,255 | 5/1960 | Fitzer | 148/6.3 |
| 3,259,526 | 7/1966 | Walker et al. | 148/6.35 |
| 3,660,173 | 5/1972 | Matsuno et al. | 148/6.3 |
| 3,704,176 | 11/1972 | Oga et al. | 148/6.3 |
| 3,929,610 | 12/1975 | Wang | 204/13 |
| 4,017,336 | 4/1977 | Foroulis | 148/6.35 |

FOREIGN PATENT DOCUMENTS

| | | | |
|---|---|---|---|
| 114649 | 2/1942 | Australia | 148/6.35 |
| 1278804 | 9/1968 | Fed. Rep. of Germany | 148/6.3 |

*Primary Examiner*—Ronald H. Smith
*Assistant Examiner*—S. L. Childs
*Attorney, Agent, or Firm*—John L. Sniado; Anthony M. Lorusso

[57] ABSTRACT

Disclosed is a technique for providing a protective oxide layer on an alloy. The technique involves the preliminary cleaning of the alloy's surfaces to remove as much unwanted oxide as possible and the subsequent exposure of the alloy surface to an environment which produces an acid resistant oxide by selective oxidation of one of the constituents of the alloy and which acts as a reducing environment for other constituents of the alloy. For the production of a chromium oxide layer on a stainless steel comprising chromium, iron, and nickel, a suitable environment includes a 600°-1200° C. mixture of $H_2$ and $H_2O$. If a major portion of the mixture is $H_2$, the chromium is oxidized whereas the iron and nickel are not.

2 Claims, No Drawings

PROCESS FOR PROVIDING ACID-RESISTANT OXIDE LAYERS ON ALLOYS

BACKGROUND OF THE INVENTION

The present invention relates to the provision of protective oxide layers on alloys.

While oxides form naturally on most alloys (e.g., iron and nickel oxides on steels), the oxides most commonly formed in this way are a mere nuisance and of little value in protecting the underlying alloy. An example of the necessity of a protective layer can be found in the stainless steel cathodes employed in apparatus for the electroformation of metallic strands. Such cathodes are discussed in U.S. Pat. No. 3,929,610, issued Dec. 30, 1975, entitled "Electroformation of Metallic Strands", owned by the assignee of the present application, and incorporated herein by reference.

As discussed in that patent, epoxy or other electrically insulated material is used as a coating on a stainless steel cathode to provide insulation and protection against the corrosive acid solution and to allow electrodeposition of metals (e.g., Cu) at the unprotected cathode areas. Eventual failure of the cathode often occurs at the bond between the stainless steel and the epoxy. It is believed that the conventional oxides which exist on the stainless steel surfaces and are not resistant to acid contribute to such cathode failure.

It has been proposed to coat the stainless steel with oxides such as $Al_2O_3$ before application of the epoxy. Such coatings, however, tend to crack during actual use due to differences in thermal expansion characteristics between the underlying material (e.g., stainless steel) and the applied oxide coating.

In view of the foregoing, it is a principal object of the present invention to provide an improved technique for achieving a protective oxide layer on an alloy.

Another object is to provide a method of furnishing an acid resistant oxide coating on a large number of different alloys.

Yet another object of the invention is to provide a durable and acid resistant oxide layer on stainless steel alloys.

SUMMARY OF THE INVENTION

Briefly, the present invention comprises a method for providing an acid-resistant oxide layer on an alloy comprising the steps of preliminarily cleaning the surface of the alloy and then exposing the clean surface to an environment specifically selected to produce an acid resistant oxide by selective oxidation of one of the alloy's constituents while providing a reducing environment for its other constituents. By way of example, when the alloy is stainless steel, the environment may be chosen to oxidize chromium and to be a reducing environment for other constituents such as iron and nickel. One specific example of such an environment is a heated mixture of $H_2$ and $H_2O$, with the $H_2$ component being the major component of the mixture. Other examples include the provision of an aluminum oxide on an alloy containing aluminum and iron, and an aluminum oxide on an alloy containing aluminum and titanium.

DETAILED DESCRIPTION OF THE INVENTION

The use of oxide layers on electrodeposition cathodes to improve bonding of insulating materials to surfaces of the cathodes was suggested in U.S. Pat. No. 3,929,610, mentioned above. Those proposals involved either the conventional, non-selective oxidation of constituent metals in stainless steel and/or the coating of a metallic cathode with an oxide of another metal. However, the non-selective oxidation of stainless steel results in the presence of oxides that can easily be attacked by acids (e.g., iron oxide and nickel oxide). Use of oxide coatings of other metals gives rise to problems of cracking due to differences in thermal expansion between the underlying cathode metal and the oxide.

According to the present invention, it has been realized that selective oxidation of a constituent of the alloy forming the cathode overcomes many of the difficulties inherent in the foregoing prior art techniques.

Broadly, the process of the invention is applicable to an almost limitless number of alloys, provided they contain a constituent which can form an acid-resistant oxide. A particular metal oxide may be determined to be acid-resistant by reference to widely available data. Non-limiting examples of metals which form acid-resistant oxide coatings include chromium, aluminum, berillium, hafnium, titanium, and silicon. In contrast, the oxides of calcium, magnesium, iron, nickel, and manganese are not acid resistant. In addition, for best results there should be a relatively large difference in the free energy of oxide formation between the base metal and the metal to be oxidized, i.e., the metal to be oxidized should have an oxide of high free energy of formation (e.g., Al, Cr, Si, Ti, Hf, etc.) and the base metal an oxide of relatively low free energy of formation (e.g., Fe, Cu, Ni, etc.). In general, a difference in free energy of formation of at least about 10,000 Kcal will be ideal. Tables which disclose the free energy of formation of various metal oxides may be found, for example, in any recent edition, of the *Handbook of Chemistry and Physics* (Chemical RubberPublishing Co.).

When the process of the invention is practiced for the purpose of forming improved electrodeposition cathodes of the type described above, in addition to the foregoing properties, the alloy must be capable of being readily plated and stripped of copper or other metal selected for electrodeposition.

In the process of the invention, a clear surface is provided on the alloy and that surface is then exposed to a selected environment at a suitable pressure and temperature for a sufficient length of time to oxidize the selected alloy component while leaving other components unaffected. This procedure results in an acid-resistant oxide coating tenaciously adhered to the cleaned surface.

The nature of the environment to which a particular alloy may be exposed to become selectively oxidized as described necessarily depends on the particular makeup of the alloy. However, the permissible makeup and the temperature and pressure range of the environment can be readily determined with the aid of known thermodynamic data. Accordingly, the identity of the particular acid-resistant oxide to be grown and the identity or identities of the particular non-acid-resistant oxides to be inhibited will determine the parameters and nature of the environment to which the alloy is exposed in the method of the invention.

Thus, from the free energies of formation of the various oxides involved, the makeup of the atmosphere necessary to effect this selective oxidation may be determined. The equilibrium partial pressure of oxygen for the oxidation of an element M at a given temperature which undergoes an oxidation of:

$$xM + O_2 \rightarrow M_xO_2$$

can be obtained from the known formula:

$$\Delta F^\circ = -RT \ln (1/P_{O2})$$

wherein $\Delta F^\circ$ is the free energy of formation of the oxide of element M, R is the gas constant, and T is the absolute temperature and $P_{O2}$ is the partial pressure of oxygen in equilibrium with the oxide at the temperature T. The ratio of $H_2/H_2O$, $CO/CO_2$, etc. corresponding to each pressure may be obtained from the relationships:

$$\Delta F.^\circ = -RT \frac{(P_{H2O})^2}{(P_{H2})^2 P_{O2}}$$

where the reaction is $2H_2 + O_2 = 2H_2O$ or:

$$\Delta F.^\circ = -RT \ln \frac{(P_{CO2})^2}{(P_{CO})^2 P_{O2}}$$

where the reaction is $2CO + O_2 = 2CO_2$.

$\Delta F^\circ$, for a given oxidation reaction, may be obtained from the *Handbook of Chemistry and Physics.* Exemplary data for some elements and carbon monoxide at 1200° C. are set forth below.

| | $\Delta F.^\circ$ (K cal) | $P_{O2}$ (atm) | $H_2/H_2O$ | $CO/CO_2$ |
|---|---|---|---|---|
| $2H_2 + O_2 = 2H_2O$ | −78,000 | | | |
| $2CO + O_2 = 2CO_2$ | −74,000 | | | |
| $2Ni + O_2 = 2NiO$ | −51,000 | $3 \times 10^{-8}$ | 0.01 | 0.02 |
| $2Fe + O_2 = 2FeO$ | −80,000 | $10^{-12}$ | 1 | 3 |
| $4/3\ Cr + O_2 = 2/3\ Cr_2O_3$ | −118,000 | $5 \times 10^{-18}$ | $8 \times 10^2$ | $2 \times 10^3$ |
| $Ti + O_2 = TiO_2$ | −153,000 | $10^{-23}$ | $4 \times 10^5$ | $8 \times 10^5$ |
| $4/3\ Al + O_2 = 2/3\ Al_2O_3$ | −192,000 | $5 \times 10^{-29}$ | $5 \times 10^8$ | $7 \times 10^8$ |

These values vary with temperature. For example, at 800° C., the values for hydrogen, carbon monoxide, iron, and chromium turn out to be as follows:

| | $\Delta F.^\circ$ (K cal) | $P_{O2}$ (atm) | $H_2/H_2O$ | $CO/CO_2$ |
|---|---|---|---|---|
| $2H_2 + O_2 = 2H_2O$ | −90,000 | | | |
| $2CO + O_2 = 2CO_2$ | −91,000 | | | |
| $2Fe + O_2 = 2FeO$ | −94,000 | $5 \times 10^{-20}$ | 3 | 2 |
| $4/3\ Cr + O_2 = 2/3\ Cr_2O_3$ | −134,000 | $2 \times 10^{-28}$ | $5 \times 10^4$ | $3 \times 10^4$ |

Thus at 800° C., an environment comprising a mixture of $H_2$ and $H_2O$ having a $H_2/H_2O$ ratio between 3 and $5 \times 10^4$, would reduce iron oxide and oxidize chromium. Similarly, an atmosphere having a $CO/CO_2$ ratio between 2 and $3 \times 10^4$ would reduce iron oxide and oxidize chromium. Alternatively, it can be seen that FeO powder could be used to oxidize chromium. Of course, as the lower limit of the ratio is approached, the chances that iron would be oxidized increases, and as the upper limit is approached, the rate of reaction becomes unfavorable. Thus a practical range of the $H_2/H_2O$ ratio would be about 5 to $2 \times 10^4$.

As will be apparent to those skilled in the art, a large number of operable gaseous, liquid, and solid environments will suffice to effect the selective oxidation.

To achieve a substantially uncontaminated acid-resistant oxide layer, as mentioned previously, the original metallic surface should be clean and as free as possible of oxides prior to the selective oxidation treatment. Such a surface condition is achievable with a pre-treatment procedure involving, for example, exposure to dry hydrogen at high temperatures (e.g., 850° C.). One such pre-treatment cleaning procedure involves the steps of sand blasting, etching, rinsing, drying, and exposing the alloy to an atmosphere containing dry hydrogen at 850° C. for four hours.

The invention will be further understood from the following non-limiting examples, wherein all percentages and ratios are expressed in weight units unless otherwise indicated.

EXAMPLE 1

A 1 foot × 1 foot × ⅛ inch stainless steel plate consisting of iron, 18% chromium, and 8% nickel was sand blasted, etched, rinsed, dried, and subjected to a four hour exposure to hydrogen at 850° C. The steel bar was then placed in a sealed container having an atmosphere of 100 parts $H_2$ and 1 part $H_2O$ ($H_2/H_2O = 100$). The contents of the container were then heated to 800° C. and the clean surfaces of the bar became coated with a greenish brown-black substance, which, on analysis, was found to consist mostly of chromium and oxygen.

Thermodynamic data indicates that the temperature within the container may vary within the range of about 600° C. to about 1200° C., the only effect of such variation being a change in reaction rate.

EXAMPLE 2

A stainless steel plate similar to the plate of Example 1, after cleaning, is subjected to an atmosphere of 100 parts CO and 1 part $CO_2$ for four hours at 850° C. An oxide coating of chromium indistinguishable from that of the coating of Example 1 results. The suitable $CO/CO_2$ ratio range is between about 1 and $1 \times 10^4$, the particular ratio selected and the temperature of the treatment being determinative of the reaction rate.

EXAMPLE 3

A stainless steel comprising 4% Al, 13% Cr, and 83% iron, after thorough cleaning as outlined in Example 1, is placed in an evacuated chamber together with $Cr_2O_3$ powders, and heated to 800° C. A thin layer of $Al_2O_3$ results. Once the aluminum oxide layer is formed, the chromium and iron base metals are protected from oxidation and a thicker layer may be deposited by subjecting the alloy to air or oxygen at a temperature suitable to attain a given reaction rate.

EXAMPLE 4

A titanium alloy containing 8% Al, 1% Mo, and 1% V, after cleaning, is placed in an evacuated chamber, with $TiO_2$ powder, and heated to 1200° C. A thin layer of pure $Al_2O_3$ results. Once the aluminum oxide layer is formed, the titanium, molybdenum, and vanadium base metals are protected and a thicker layer of $Al_2O_3$ may be grown by subjecting the alloy to air or oxygen at a temperature suitable to attain a given reaction rate such as 1200° C.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A process for providing a stable, acid-resistant coating on the surface of a titanium alloy containing aluminum, said process comprising the steps of:

providing a clean surface on the alloy;

exposing the clean surface to an environment containing oxygen which is oxidizing with respect to aluminum and reducing with respect to the titanium constituents of said alloy; and maintaining the environment at a selected temperature for a sufficient amount of time to form an aluminum oxide coating on the surface and reduce the titanium to form an acid-resistant coating of the alloy.

2. The process as set forth in claim 1 comprising the further step of exposing the aluminum oxide coated surface to oxygen for a sufficient amount of time and at a selected temperature to thicken the coating.

* * * * *